US008156879B2

(12) United States Patent
Hanchar

(10) Patent No.: US 8,156,879 B2
(45) Date of Patent: Apr. 17, 2012

(54) SAILING CRAFT COMPRISING A TILTING RIGID SAIL SYSTEM

(76) Inventor: Dale William Hanchar, Calgary (CA)

( * ) Notice: Subject to any disclaimer, the term of this patent is extended or adjusted under 35 U.S.C. 154(b) by 0 days.

(21) Appl. No.: 12/955,752

(22) Filed: Nov. 29, 2010

(65) Prior Publication Data

US 2011/0114002 A1 May 19, 2011

Related U.S. Application Data

(63) Continuation-in-part of application No. 11/955,357, filed on Dec. 12, 2007, now abandoned.

(51) Int. Cl.
*B63H 9/04* (2006.01)

(52) U.S. Cl. ..... 114/39.29; 114/102.16; 114/90

(58) Field of Classification Search ..... 114/90, 114/39.21–39.32, 102.1–115
See application file for complete search history.

(56) References Cited

U.S. PATENT DOCUMENTS 2,170,914 A * 8/1939 Rummler ..... 114/39.31

* cited by examiner

*Primary Examiner* — Edwin Swinehart
(74) *Attorney, Agent, or Firm* — Gordon Thomson

(57) ABSTRACT

A sailing craft propelled by a tilting sail system comprising an aerofoil sail capable of omni-directional attitude for wind propulsion. The sail is fixed to the craft in such a manner as to permit omni-directional attitude. Sail control means allows the sail placement in a forward propulsion attitude relative to wind direction. The sail is rigid and has an asymmetric shape.

11 Claims, 12 Drawing Sheets

SAILING CRAFT COMPRISING A TILTING RIGID SAIL SYSTEM

CROSS-REFERENCES TO OTHER APPLICATIONS

This application is a continuation-in-part of U.S. patent application Ser. No. 11/955,357 filed on Dec. 12, 2007 now abandoned.

FIELD OF THE INVENTION

This invention pertains to sailing craft and tilting sail systems and more particularly to a sailing craft comprising a tilting rigid sail system.

BACKGROUND OF THE INVENTION

Sailing craft and sail systems are well known. The idea of putting a rigid aerofoil-type sail on a sailing craft is discussed in U.S. Pat. No. 2,170,914 issued to Rummler and U.S. Pat. No. 1,670,936 issued to M. McIntyre et al. The primary problem associated with these craft and sail systems pertains to "staying" the sails and rigging using cables and rope while allowing active portions to move freely in order to operate properly. As illustrated by U.S. Pat. No. 4,068,607 the cable-based rigging and stay controls are very complicated and difficult for a small crew or single operator to operate.

What is therefore required is a rigid sail system that can be operated with a minimum of stays and rigging by one operator or a small crew.

OBJECTIVES AND ADVANTAGES OF MY INVENTION

My invention is a novel and ingenious improvement to the present rigid sail systems with the following objectives and advantages:

1. The sail shape does not depend on the wind and it maintains a constant curvature regardless of wind speed or direction for maximum generation of thrust;
2. The constant sail shape allows the sail craft to be sailed "close to the wind" resulting in quicker tacks, fewer stalls and optimized forward thrust;
3. The sail system operates without a boom that swings low amidships;
4. The sail system is self-weather cocking to the mast and will turn into the wind automatically;
5. The sail system controls are simple and may be confined to a single winch operable by a single operator;
6. The sail system permits more sail area than traditional soft sails because the rigid sail system can be angled to reduce heel and has a low centre of effort;
7. The control of the heel of the sail craft is accomplished in three ways: through the manipulation of sail tilt, the mainsheet and the rudder;
8. The rigid sail system permits the craft to lift from the water and therefore increases speed of the craft by reducing hull drag;
9. The rigid sail system offers a simplified control for one operator or a small crew;
10. The rigid sail system exemplified herein can be applied to craft of all sizes from toy vessels to large cargo vessels with a varying configuration of hulls, such as, mono and multi hulls;
11. The rigid sail system exemplified herein can be operated by computers with wind speed and direction sensors to automatically adjust the sails for optimized thrust. This can save significant fuel costs for commercial vessels; and,
12. The large surface area of the rigid sail is adaptable to coverage by flexible photo-voltaic cells permitting power generation for the electrical needs of the craft.

SUMMARY OF THE INVENTION

To overcome the deficiencies in prior art rigid sail systems and accomplish the objectives set out herein, my invention is a sail craft comprising a tilting rigid sailing system. The sailing craft has a hull having a bow and a stern, a port side and a starboard side. The tilting rigid sail system comprises a sail comprising an rigid aerofoil body capable of omni-directional attitude for wind propulsion. The rigid aerofoil body comprises a top skin and a bottom skin and a frame. The rigid aerofoil body encloses a volume of air and has a centre of gravity. The tilting rigid sail system further comprises a vertical mast for supporting the aerofoil body. The vertical mast has a top end mounting a swivel and pivot joint for connecting to the aerofoil body by way of a mounting member at a point disposed above the centre of gravity so that the aerofoil body is biased towards a horizontal position upon the loss of control line tension. The swivel and pivot joint permits and allows omni-directional attitude of the aerofoil body. The vertical mast has a bottom end fixed to the sailing craft. There is a wind force damper disposed within the top end of the vertical mast and connected to the swivel and pivot joint and hence to the aerofoil body for damping wind forces transmitted from the aerofoil body to the vertical mast. There is also aerofoil body control means for controlling the attitude of the aerofoil body for optimizing aerofoil inclination and surface area exposed to wind direction and for placing the aerofoil body in a forward propulsion attitude relative to wind direction. The aerofoil body includes floatation means disposed within the aerofoil body either as inflatable air bags or styrene panels. The aerofoil body is self weather cocking.

The aerofoil body comprises a frame, a leading edge, a trailing edge, an upper camber, an air chamber, a width, a length, a centre line, a port side, and a starboard side. The frame comprises at least four parallel ribs, including a port side rib, a starboard side rib and at least two interior ribs disposed between the port side rib and the starboard side rib. The four parallel ribs are fixed to a leading edge spar member and a spar member disposed between the leading edge and the trailing edge of the body. In other embodiments of the aerofoil body there could be more than four ribs.

The pivot joint comprises a first and second yoke having a respective first and second axle sleeve. The first and second yoke are fixed to the mounting member which is in turn fixed to the aerofoil body above the centre of gravity. The pivot joint further comprises an axle mounted in said first and second axle sleeves. The swivel joint comprises a vertical member having a member top end and an member open bottom end. The member open bottom end is disposed within the vertical mast top end for rotational and reciprocating movement therein. The member top end is fixed to a centre point of the axle.

The wind force damper comprises a first member horizontally disposed within the vertical mast and fixed at a position below the vertical mast top end and a damping spring disposed within the vertical mast top end. The damping spring has a spring bottom end and a spring top end. The spring bottom end rests upon the first horizontally disposed member. There is a second member horizontally disposed within the vertical member and fixed within the vertical member at a middle position. The second horizontally disposed member rests upon the spring top end and transfers the wind forces from the aerofoil body to the damping spring.

The control means comprises a first control line having a first end fixed to the leading edge and below the centre of gravity and a second end anchored to the vertical mast at a point proximate to the bottom end of the vertical mast. The first control line is tensioned to control pitch of the aerofoil member. Aerofoil body tilt control comprises a second control line having a first end fixed to the aerofoil body below the centre of gravity and between the port side rib and the vertical mast and a second end fixed to the aerofoil body below the centre of gravity and between the starboard side rib and the vertical mast thereby creating the second control line port. The second control line travels down-mast to a set of pulleys mounted on the mast and to a two-way winch adapted to tension alternately the second control line port and the second control line starboard, thereby tilting the aerofoil body port and starboard as desired to bias the aerofoil body to the horizontal position upon loss of control line tension.

The control means further comprises a third control line having a first end fixed to the aerofoil body at a point between the trailing edge and the vertical mast, and a second end fixed to a port-starboard traveling means fixed across the stern of the water craft. The traveling means is adapted to move from port to starboard so that the aerofoil body can be rotated about the vertical mast and secured in a desired position.

In another embodiment of the invention there is provided a sailing craft comprising a tilting sail system. The sailing craft has a hull having a bow and a stern, a port side and a starboard side. The sail tilting sail system comprises a self weather cocking sail comprising a rigid and asymmetric aerofoil body capable of omni-directional attitude for wind propulsion. The aerofoil body comprises a leading edge, a trailing edge, an upper camber, a centre line, a top skin and a bottom skin, a port side rib and a starboard side rib. The aerofoil body encloses a volume of air. There is a vertical mast having a top end fixed to the aerofoil body by a pivot/swivel joint. The bottom end of the mast is fixed to the hull. The pivot/swivel joint permits and allows omni-directional attitude of the aerofoil body. A wind force damper is disposed within said top end of the mast. There is also provided an aerofoil body control means for placing the aerofoil body in a forward propulsion attitude relative to wind direction. The aerofoil body control means comprises a first control line fixed to the leading edge for controlling aerofoil body pitch and a second continuous control line for controlling tilt of the aerofoil body having a first end fixed to the aerofoil body between the starboard rib and the mast and a second end fixed to the aerofoil body between the port side rib and the mast. The second continuous control line is tensioned port or starboard by a two-way winch. There is a third control line having a first end attached to the aerofoil body centre line between the trailing edge and the mast and a second end attached to port-starboard traveling means fixed across the stern.

These and other objects, features, and characteristics of my invention will be more apparent upon consideration of the following detailed description and appended claims with reference to the accompanying drawings, wherein like reference numerals designate corresponding parts in the various figures.

DETAILED DESCRIPTION

Figure 1:
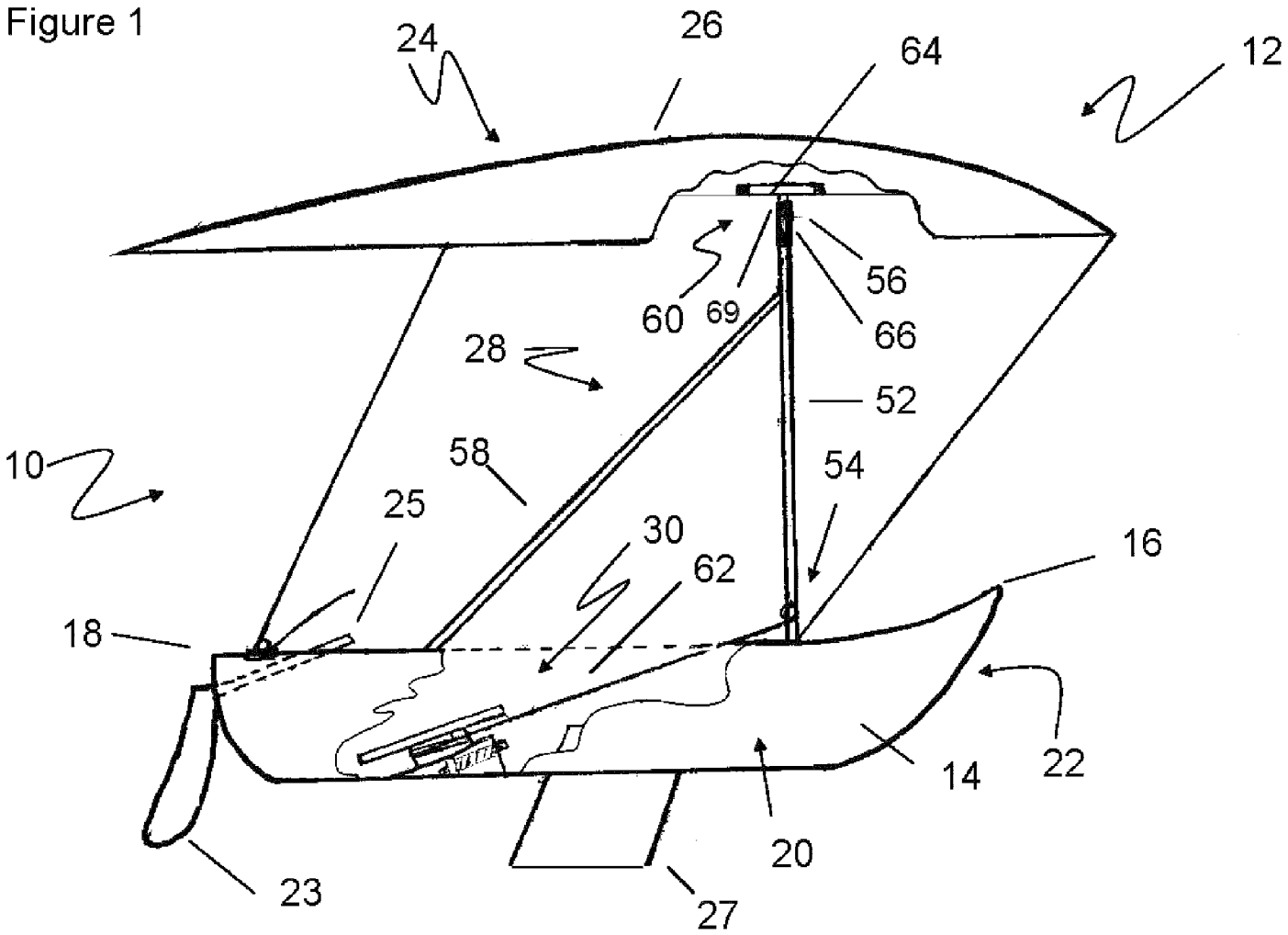
FIG. 1 is a side view of one example of my invention.

Referring to FIG. 1 there is shown in side view my invention, a sailing craft 10 comprising a tilting rigid sail system 12. The sailing craft 10 has a hull 14 having a bow 16 and a stern 18, a starboard side 20 and a port side 22. Also illustrated are rudder 23, tiller arm 25 and keel 27. The tilting sail system 12 comprises a sail 24 comprising an aerofoil body 26 capable of an omni-directional attitude for wind propulsion. The aerofoil body 26 is supported by support means 28 for fixing the aerofoil body 26 to the sailing craft 10 and permitting an omni-directional attitude of the aerofoil body. The tilting sail system further comprises aerofoil body control means 30 for placing the aerofoil body 26 in a forward propulsion attitude relative to wind direction. The aerofoil body is rigid and has an asymmetric shape. The aerofoil body is self weather cocking, that is, it will always turn itself into the wind.

Figure 2:
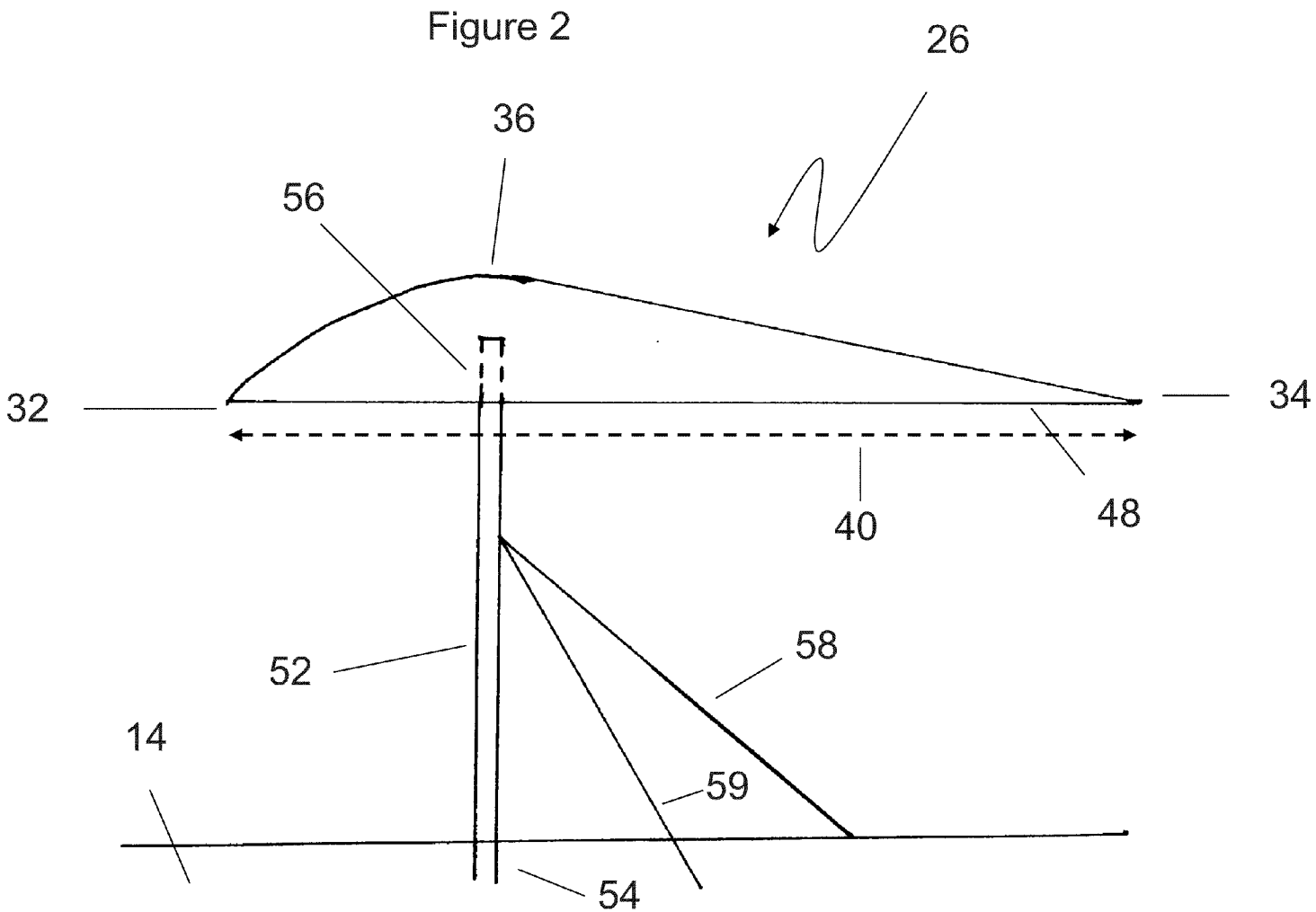
FIG. 2 is a side view of the aerofoil body and mast of another example of my invention.
Figure 3:
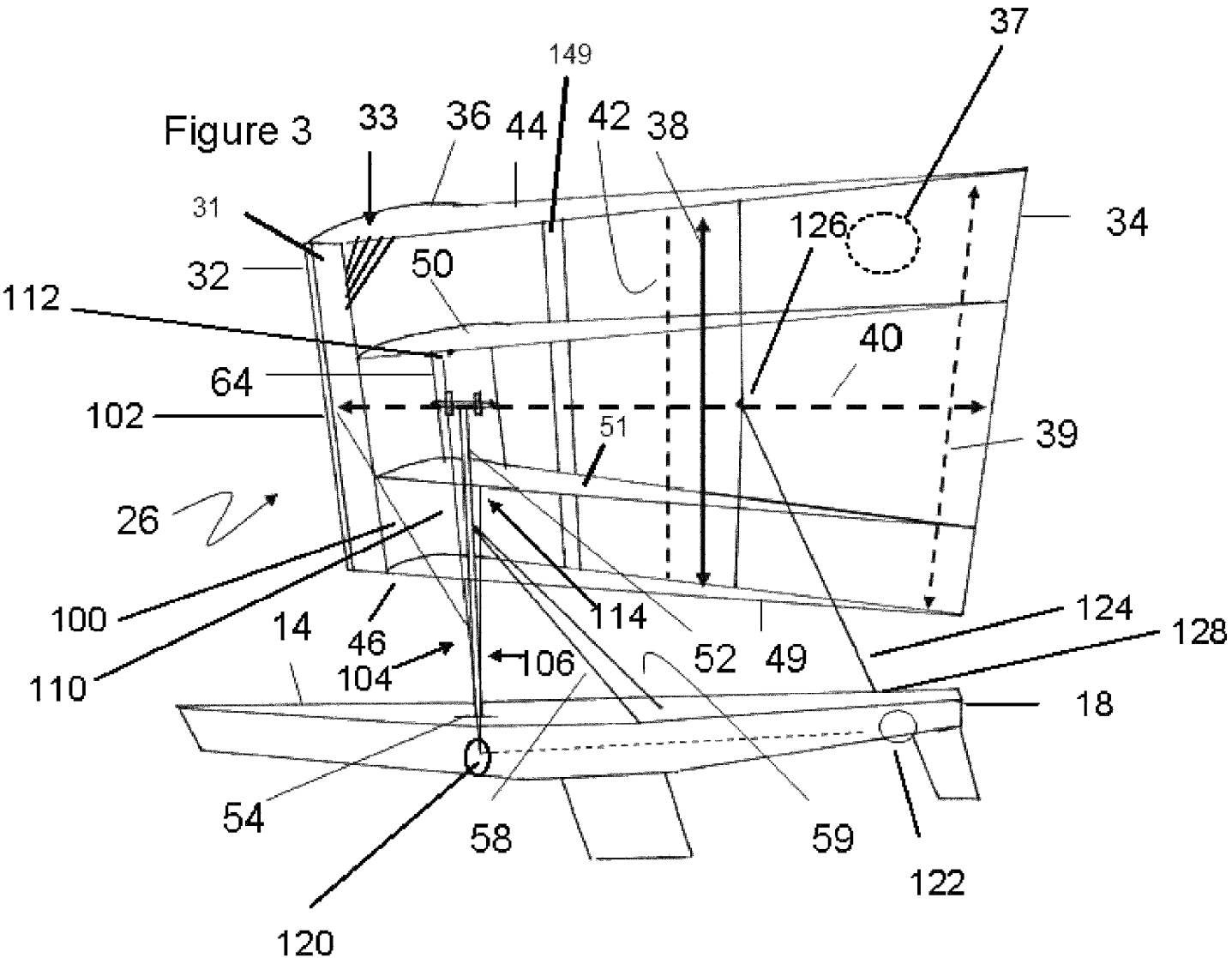
FIG. 3 is a side view of another example of my invention showing the sail in a tilted configuration.

Referring to FIGS. 2 and 3, the aerofoil body 26 comprises a leading edge 32, a trailing edge 34, an upper camber 36, a width 38, a length 40, a centre line 42, a starboard side 44, and a port side 49. The length 40 is greater than the width 38. The aerofoil body has a centre of gravity 300.

Figure 3A:
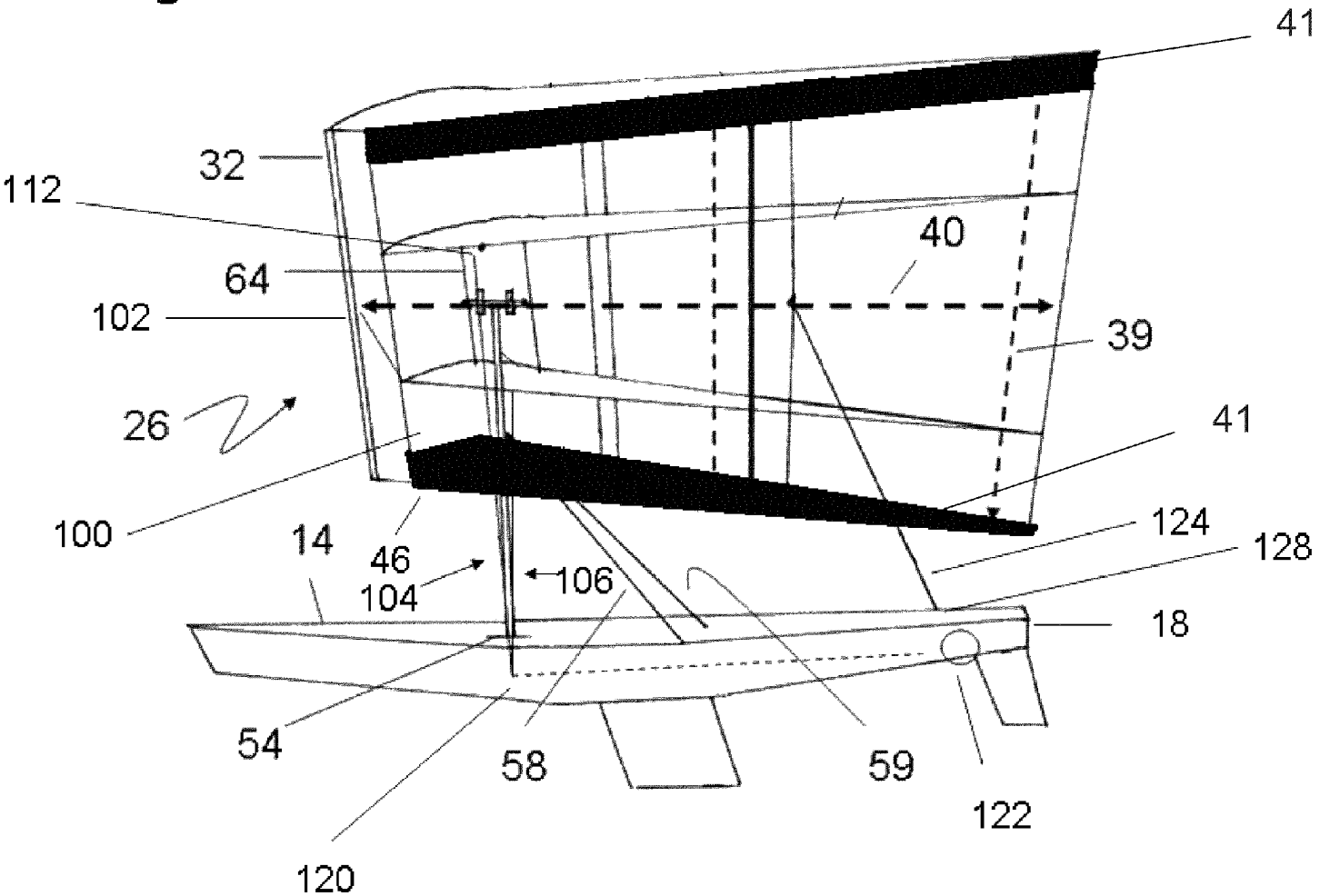
FIG. 3*a* is a side view of one example of my invention illustration floatation within the aerofoil body.

Referring to FIG. 3*a*, there is shown one embodiment of my invention having floatation means 41 within the aerofoil body. In this example, floatation means comprises styrene floatation panels fixed to the port side and starboard side ribs.

In one embodiment of the invention, the width 38 at the leading edge 32 (first width) is the same as the width (second width) at the trailing edge 34. In another embodiment of the invention the aerofoil body has a trailing edge (second) width 39 that is larger than the leading edge (first) width.

The aerofoil body 26 further includes a frame adapted to maintain an asymmetric shape. In the embodiment illustrated in FIG. 3, the frame comprises at least four ribs comprising a port side rib 44, starboard side rib 46, internal rib 50 and internal rib 51. In other embodiments of the invention the frame may have more interior ribs to support the sail body. The frame ribs are fixed to a leading edge spar frame member 31 and a spar frame member 149 disposed between the leading edge spar frame member 31 and the trailing edge 34 of the body 26.

In a conventional sailing system, to stop the craft with soft sail the operator must either turn the craft into the wind or let the sail out with the main sheet to let it luff in the wind. This has the effect of aerodynamically braking the craft. In a high wind situation the soft sail will thrash about severely and needs to be taken down or furled in. With the rigid sail of the present invention the operator can let out the main sheet and let the rigid sail turn with the wind. It will thrash about because it is rigid. The other option for the operator is just to tilt the rigid sail to a more horizontal position which will lessen the forward drive force and make the rigid sail more vertical. The aerodynamic flow over the sail remains smooth without the sail thrashing. There is no need to furl the rigid sail. To level the craft into a more horizontal plane, the rigid sail can be tilted to a more horizontal attitude which results in less forward drive but more vertical lift on the hull. This has the effect to reducing the heeling of the craft. In a conventional sail system, the operator has to steer the craft more windward or let the main sail off and spill wind. This reduces the forward momentum of the craft. With my invention, the operator has merely to tilt the sail less, that is, bring it to a more horizontal attitude, and the craft heel will lessen without reducing forward momentum of the craft because the air flow will remain constant across the sail surface.

Referring to FIGS. 1, 2 and 3, the aerofoil body 26 support means 28 comprises a vertical mast 52 having a bottom end 54 fixed to the hull 14 and top end 56 for mounting the aerofoil body 26. There are stay members 58 and 59 fixed between the vertical mast 52 and the hull 14 to provide stability to the vertical mast. The centre of gravity of the aerofoil is shown at 69.

The sailing craft 10 further comprises aerofoil body 26 control means 30 for placing the aerofoil body in a forward propulsion attitude relative to wind direction. Control means 30 includes means for controlling the attitude of the aerofoil body for optimizing aerofoil inclination and surface area to wind direction. Means for controlling the attitude of the aerofoil body comprises swivel and pivot joint 60 connecting the second end 56 of the vertical mast 52 to the aerofoil body 26 permitting the aerofoil body to adopt a plurality of desired inclination angles.

Swivel and pivot joint 60 comprises a mounting member 64 fixed to the frame above the centre of gravity 69 for mounting the swivel and pivot joint to the aerofoil body 26. The centre of gravity 69 of the aerofoil body is disposed below the mounting member 64 so that the aerofoil body is biased towards a horizontal position upon loss of control line tension. The swivel and pivot joint permits and allows omnidirectional movement of the aerofoil body.

Referring to FIGS. 1, 2, 3 and 4 swivel and pivot joint 60 also include a wind force damper 66 fixed to the swivel and pivot joint and disposed within the second end 56 of the vertical mast 52 for damping forces induced into the swivel and pivot joint by wind. Swivel and pivot joint comprises swivel joint for permitting the aerofoil body to swivel 70 around the vertical mast; and, pivot joint 72 for permitting pivoting 74 of the aerofoil body 26.

Wind force damper 66 comprises a first member 76 disposed within the vertical mast 52 proximate to the second end 56. There is a damping spring 78 disposed within the vertical mast 52. The damping spring has a first end 80 and a second end 82. The first end of the spring 80 rests upon the first member 76. There is also a second member 84 disposed within a third member 86. The second member 84 rests upon the second end 82 of the damping spring 78 and is adapted to transfer forces from the swivel and pivot joint to the damping spring. The third member 86 has a first end 88 adapted to receive the second end 82 of the damping spring and a second end 90 fixed to an axle 92. The third member is further adapted for telescopic placement within the second end 56 of the vertical mast 52 thereby permitting reciprocating movement 85 of the third member 86 relative to the vertical mast 52 in reaction to wind forces.

Swivel joint comprises axle 92 attached by pivot joint 72 to the aerofoil body 26. The axle 92 is fixed at its midpoint 94 to the third member 86 second end 90. The third member 86 is disposed telescopically within the vertical mast second end 56 so that it is permitted free rotation about the vertical mast.

Pivot joint comprises the axle 92 mounted in a rotational relationship with a first 96 and second yoke 98. The first and second yokes are mounted to the mounting member 64 through mounting holes 101 using mounting means such as rivets or screws. Pivot joint permits pivoting of the aerofoil body.

Referring to FIG. 3, aerofoil body attitude control means comprises a first control line 100 having a first end 102 fixed to the leading edge 32 of the aerofoil body 26 and a second end 104 anchored to the vertical mast 52 at a point 106 proximate to the first end 54 thereof. The first control line is tensioned to control pitch of the aerofoil and bias it towards a horizontal orientation.

The control means further comprises aerofoil body tilt control means comprising a second control line 110 having a first end 112 fixed to the aerofoil body 26 between the starboard side 44 and the vertical mast 52 and a second end 114 fixed to the aerofoil body 26 between the port side 46 and the vertical mast 52. This creates a second control line port length and starboard length. The port and starboard lengths travel down the vertical mast 52 to a set of pulleys 120 mounted on the mast and then to a two-way winch 122 adapted to tension alternately the port length and the starboard length of the second control line 110. Tensioning either line will have the result of tilting the aerofoil body port or starboard as desired. The two-way winch 122 can be either hand operated, foot operated or motor operated.

Control means further comprises a third control line 124 or haul line having a first end 126 fixed to the aerofoil body 26 between the trailing edge 34 and the vertical mast 52 and a second end 128 fixed to port-starboard traveling means (illustrated in FIG. 6) fixed across the stern 18 of the water craft. The traveling means is adapted to move from port to starboard so that the aerofoil body can be rotated about the vertical mast and secured in a desired position.

Figure 5:
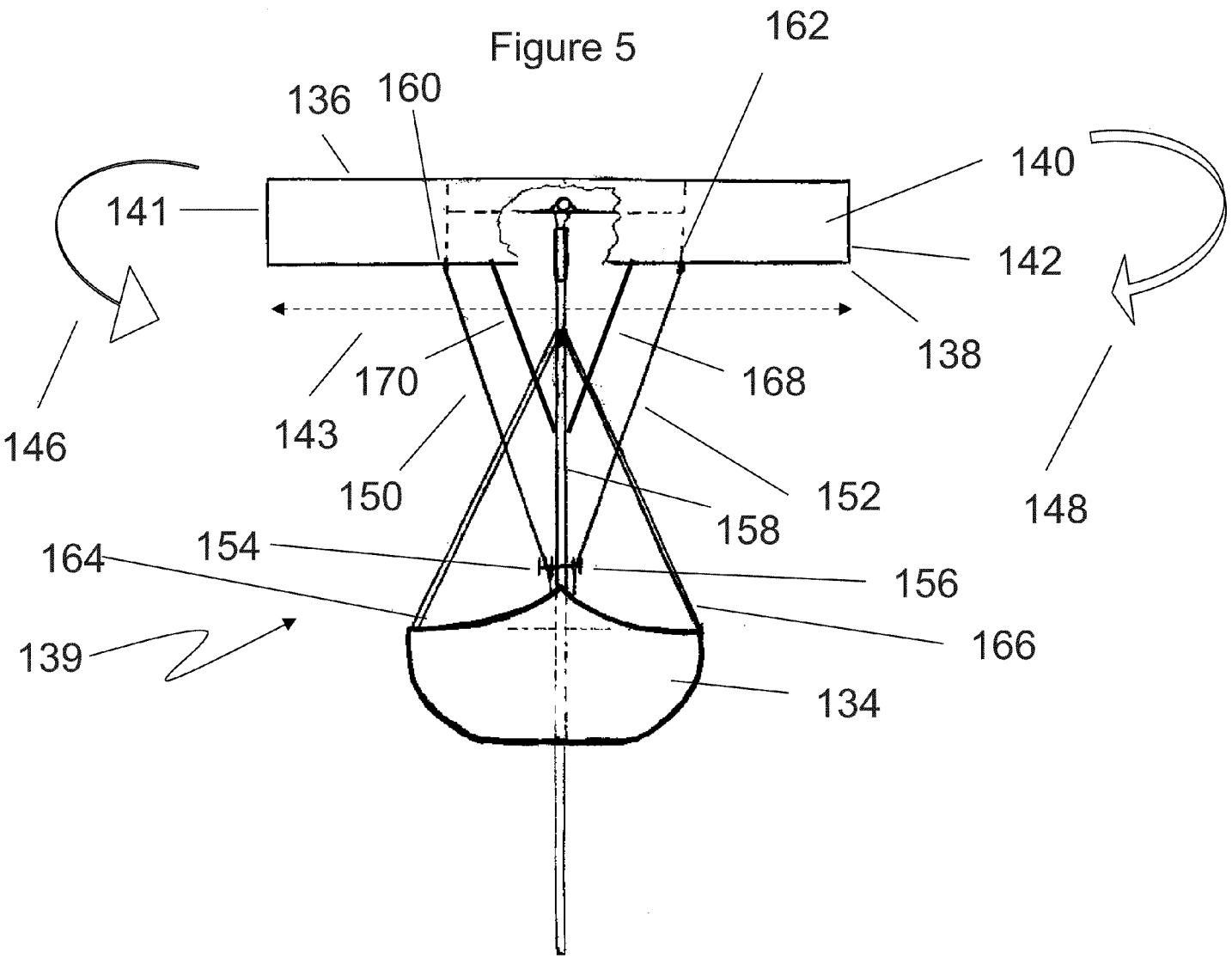
FIG. 5 is a front view of another example of my invention.

Referring now to FIG. 5, there is shown a front view of another embodiment of the invention 139. The aerofoil body 140 is shown in a horizontal position such as depicted in FIG. 2. In this position the aerofoil body is in a neutral position or non-propulsive position. However, wind across the surface of the aerofoil will have the effect of lifting the hull 134 of the vessel out of the water due to aerodynamic lift. This would be an optimal position of the sail for motoring as water resistance along the hull would be reduced. FIG. 5 illustrates the top camber 136, the leading edge 138, the width 143, the starboard side 141 and the port side 142 of the aerofoil body. The length of the aerofoil body can be varied to suit the vessel to which it is attached. Some vessels will have aerofoil bodies with short lengths and others with longer lengths. In some cases the length will be less than the width 143. As illustrated by arrows 146 and 148 the aerofoil body is adapted for tilting to either port or starboard to take advantage of wind direction for optimal propulsion. To tip the aerofoil body to starboard the starboard tilt control line 150 is tensioned by the two-way winch (illustrated in FIG. 1). To tip the aerofoil body to port the port tilt line 152 is tensioned by the two-way winch. The port and starboard tilt control lines are fed to and from the two-way winch by a respective starboard 154 and port 156 pulley blocks fixed opposite each other on the mast 158. The port and starboard tilt control lines are actually a single line have its first 160 and second 162 ends respectively fixed to framing members of the aerofoil body. The tilt control lines remain parallel to the mast and are fixed to the aerofoil body about midway between the mast and the respective port and starboard side of the aerofoil body. FIG. 5 illustrates a first 164 and second 166 rigid stay members fixed between the mast and the hull of the vessel for mast stability. Furthermore, FIG. 5 illustrates a port 168 and starboard 170 forward tension lines fixed between the leading edge of the aerofoil body and the mast to bias the aerofoil body towards a horizontal position.

Figure 6:
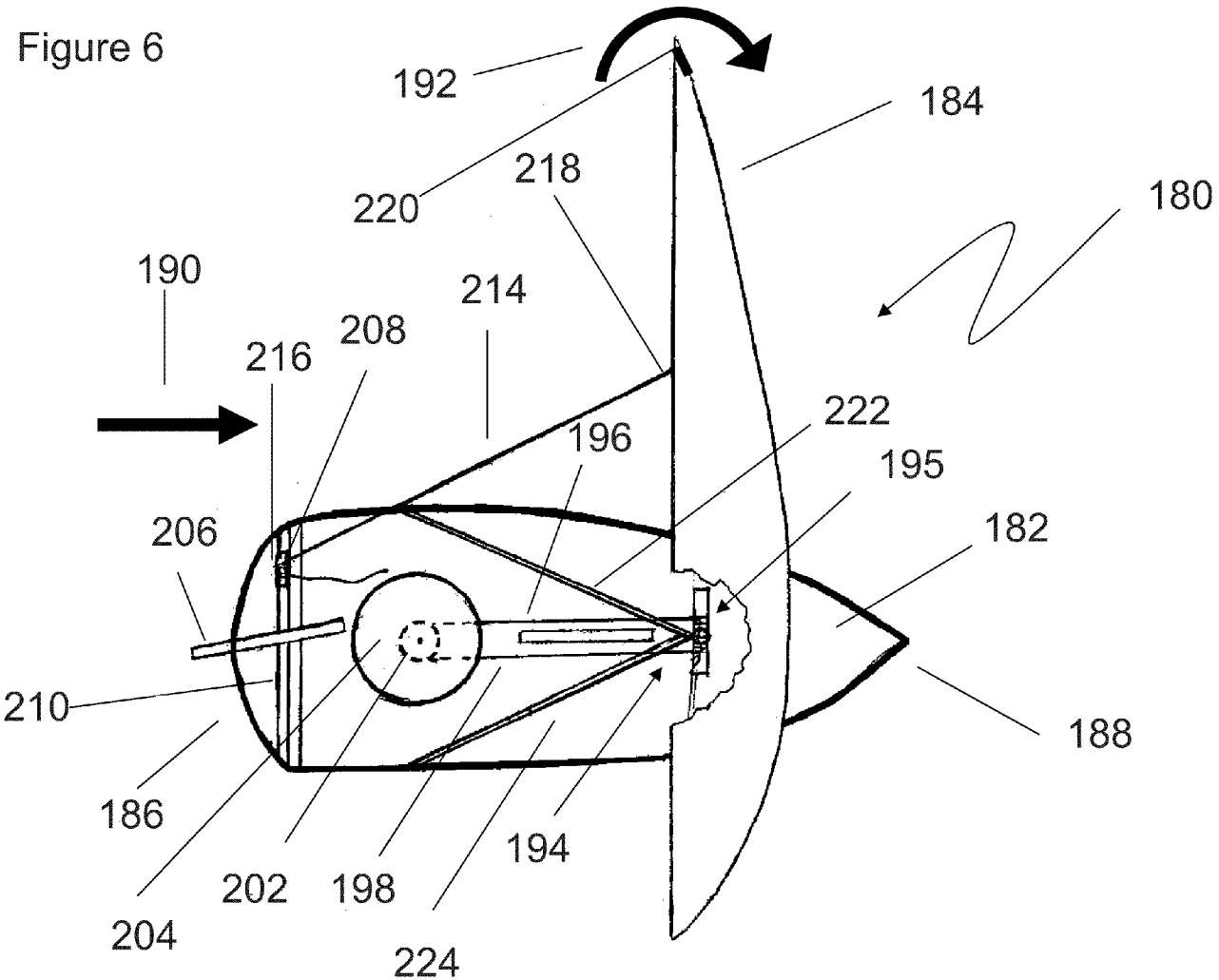
FIG. 6 is a top view of one example of my invention.

Referring to FIG. 6, there is shown a top view of an embodiment of the invention 180 illustrating the top surface of the vessel hull 182 and the aerofoil body 184 in a perpendicular relationship to the hull. This position would optimize wind propulsion from a wind blowing from the stern 186 to the bow 188 of the vessel as indicated by arrow 190.

Figure 4:
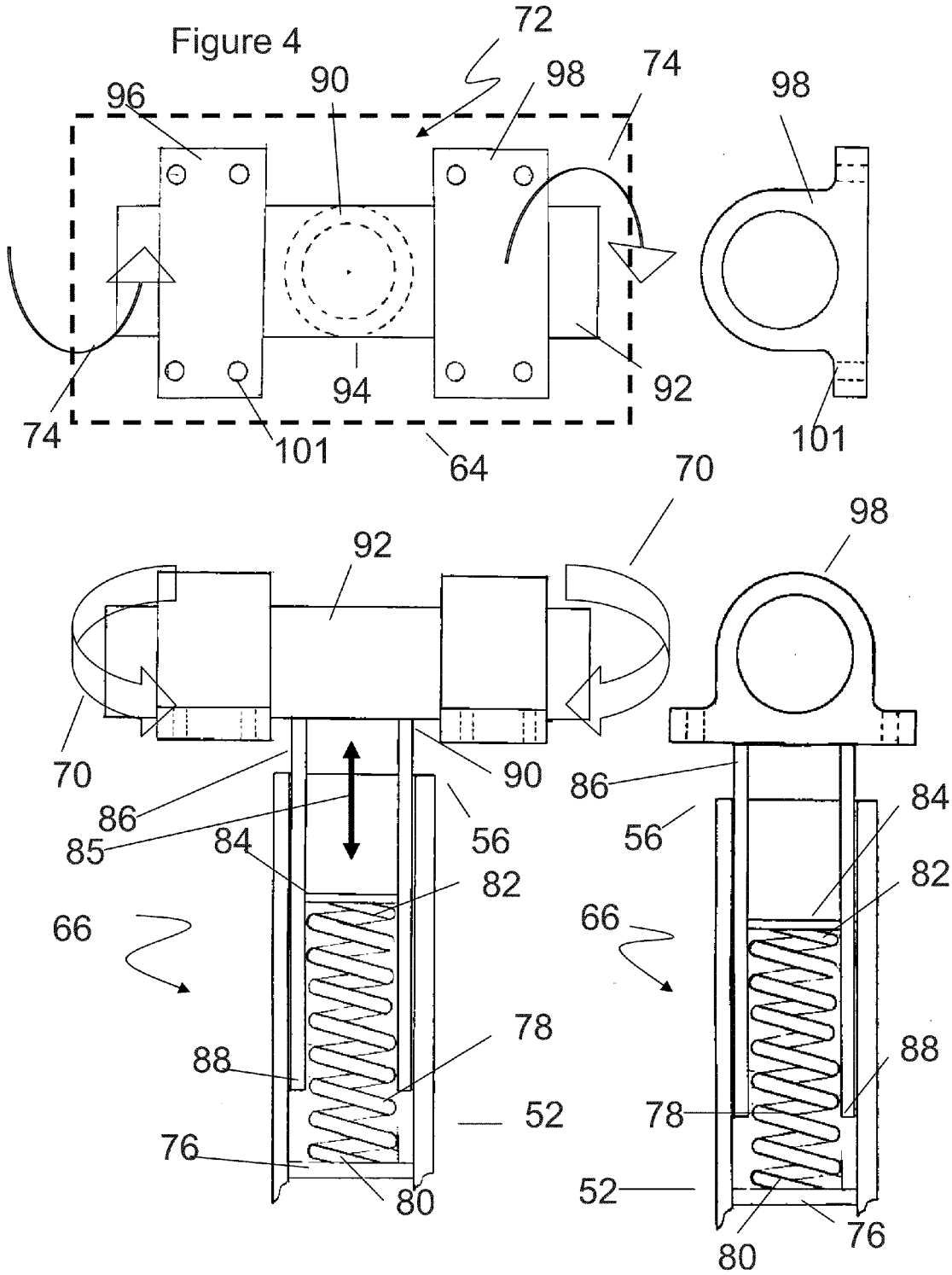
FIG. 4 is a view of the swivel and pivot joint of one example of my invention.

Referring to FIG. 4 and FIG. 6, arrow 192 indicates that the aerofoil body is able to pivot around mast 194 using the swivel and pivot joint 195 to take advantage of wind direction. In FIG. 6, the aerofoil body is tilted full to the starboard side of the vessel by pivot joint and then swiveled so that it is perpendicular to the hull of the vessel. Also illustrated in FIG. 6 are the port 196 and starboard 198 tilt control lines, which in this embodiment, travel down the mast 194 and down the centre-line of the hull to the two-way winch 202. In this embodiment the two-way is activated using a foot spinner 204 so that the operator can use both hands and feet to control the vessel. The tiller bar 206 is shown in close proximity to the two-way winch. The traveler 208 which is placed on a traveler-rod 210 across the stern 186 of the vessel is attached to the haul line 214 first end 216 and used to pull the aerofoil body trailing edge 218 towards the stern during tacking operations. The haul line second end 218 is fixed to the aerofoil body about midway between the trailing edge 220 and the mast. The port 222 and starboard 224 stays are shown fixed between the mast and the hull for mast stability.

Figure 7:
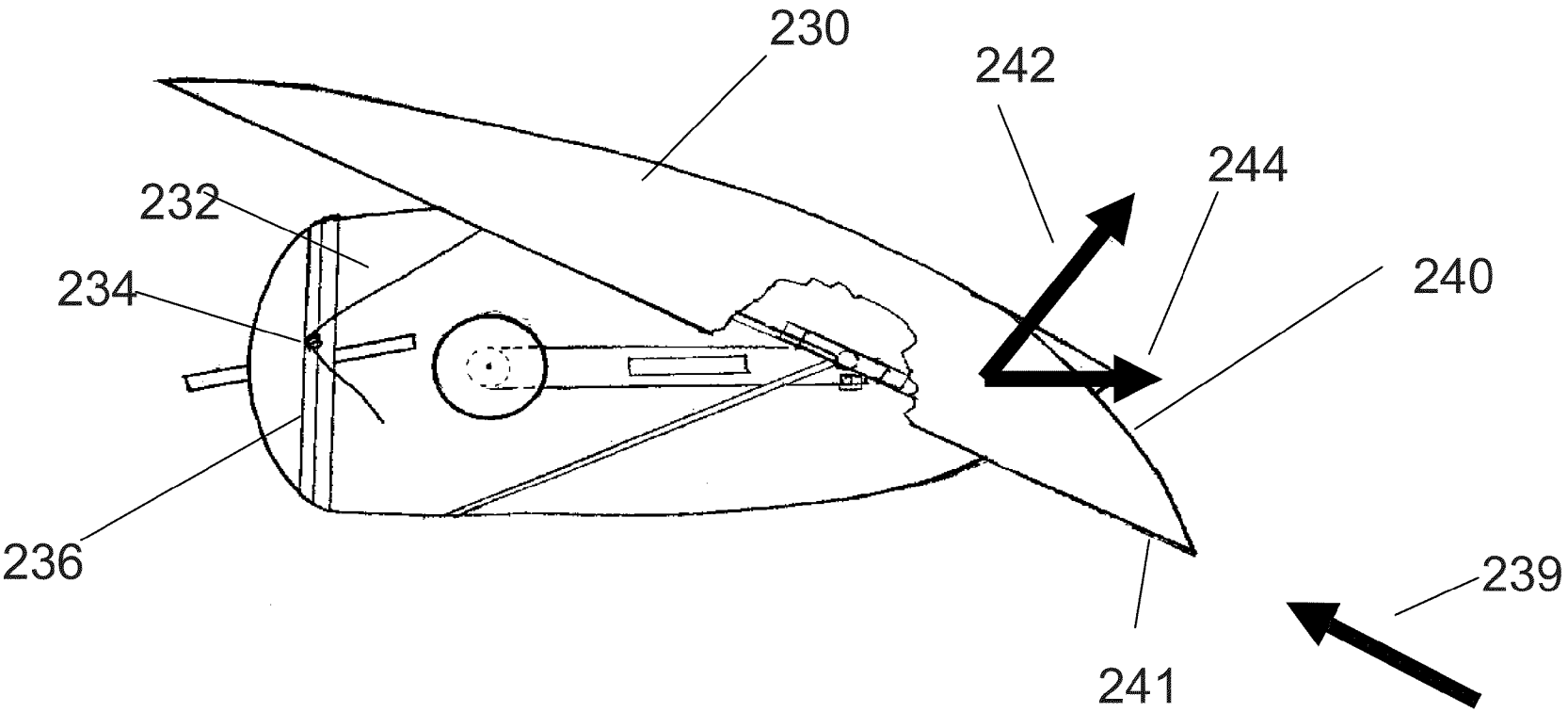
FIG. 7 is another top view of my invention.

FIG. 7 illustrates one embodiment of the invention showing one advantage of the invention. The aerofoil body 230 is tilted full to starboard and swiveled to the position illustrated using the haul line 232. Note that the traveler 234 has moved along the traveler rod 236 to a centre position. The wind direction 239 is almost bow-on being about 10 degrees to port. The aerofoil body is able to propel the vessel through the aerodynamics of lift since movement over the camber 240 of the aerofoil body will create a lift force vector 242 that can be resolved to a propulsion force 244.

Figure 8:
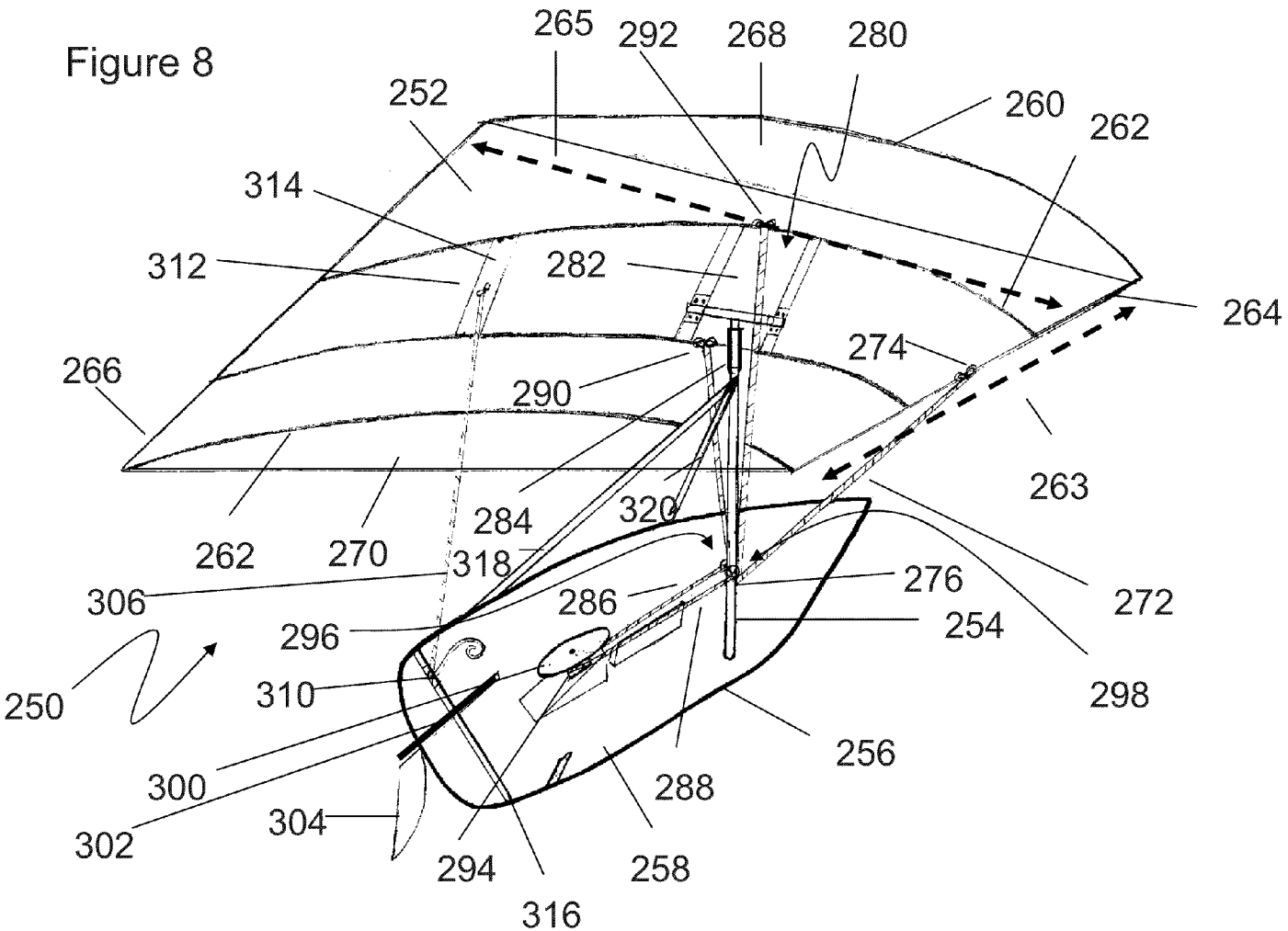
FIG. 8 is a perspective view of my invention.

FIG. 8 illustrates another embodiment of the invention 250 in a plan-perspective view. The aerofoil body 252 is mounted by mast 254 to the hull 256 of the vessel 258. The aerofoil body has a top camber 260 and maintains its shape by way of rigid framing members 262. The aerofoil body has a width 263, a length 265, a leading edge 264, a trailing edge 266, a starboard side 268 and a port side 270. A first control line 272 first end 274 is attached mid-way along the leading edge 264 of the aerofoil body and the first control line second end 276 is attached to the mast 254. The first control line is elastic and tensioned to bias the aerofoil to the horizontal position. Swivel and pivot joint 280 of the embodiment illustrated in FIG. 4 are attached to mounting member 282 between two framing members 262. The swivel and pivot joint 280 is attached in a swiveling relationship to the top end 284 of the mast. A port tilt control line 286 and a starboard tilt control line 288 have their respective first ends 290 and 292 attached to the aerofoil body framing members 262 mid-way between the mast and the port and starboard sides of the aerofoil body. The port and starboard tilt control lines are in fact a single line and engage a two-way winch 294 located in the stern of the vessel for operator tilt control. The port and starboard tilt control lines communicate with the two-way winch through port and starboard pulleys 296 and 298 respectively. The two-way winch is operable by hand or by foot using control wheel 300. The tiller bar 302 is attached to the rudder 304 and is in close proximity to the control wheel 300 so that a single operator can control and maneuver the vessel. The haul line 306 has a first end attached to traveler 310 and second end 312 attached in the rearward-middle 314 of the aerofoil body. The traveler is adapted to move port-starboard along a traveler rod 316. Port stay 318 and starboard stay 320 are illustrated fixed between the mast and the hull for mast stability.

Figure 8A:
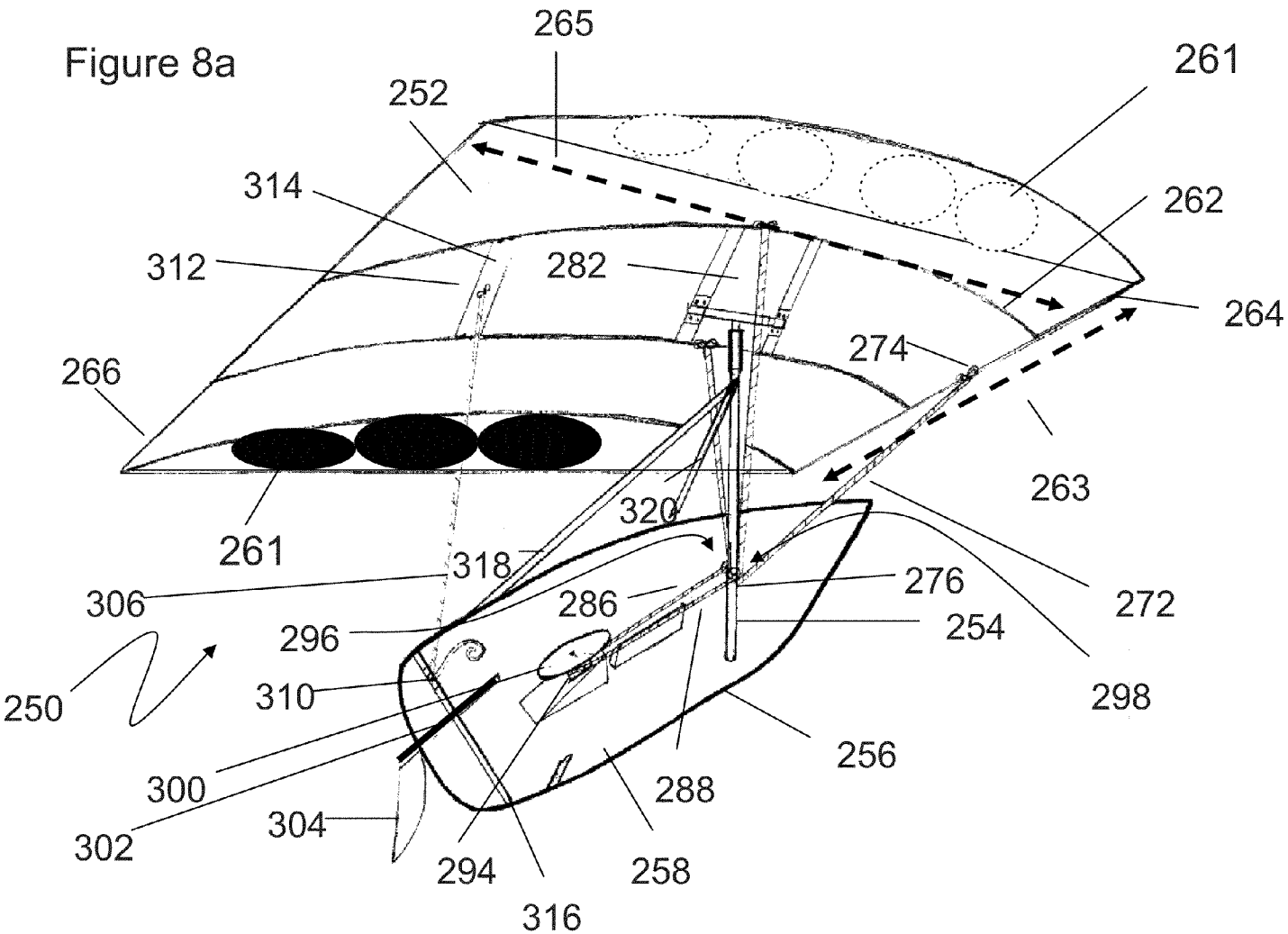
FIG. 8*a* is a perspective view of my invention showing floatation inside of the aerofoil body.

Referring to FIG. 8*a* there is illustrated one embodiment of the invention having floatation means comprising inflatable air bags 261.

Figure 9:
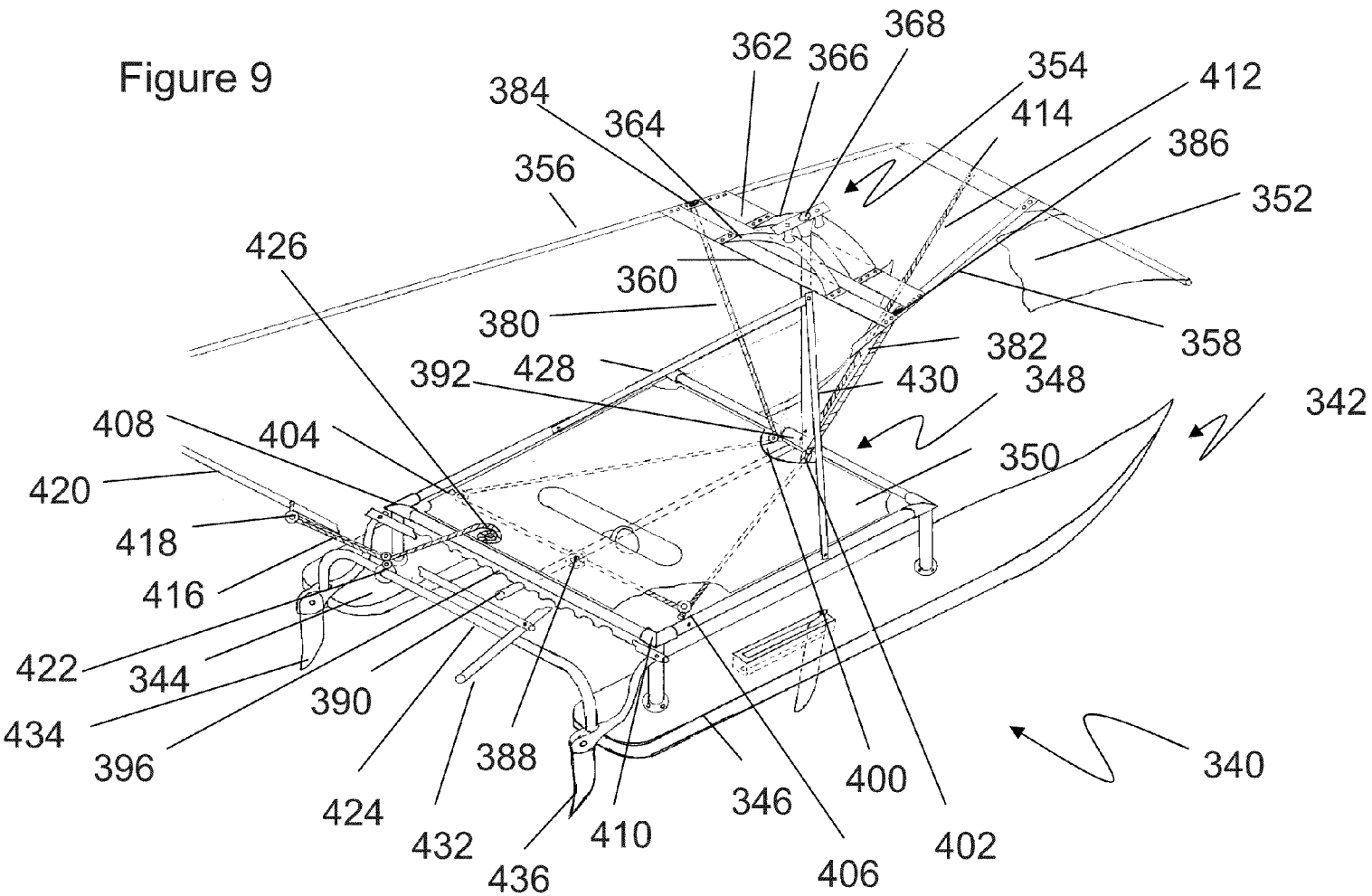
FIG. 9 is a view of my invention mounted to a catamaran hull.

FIG. 9 illustrates another embodiment of the sailing system 340 comprising a catamaran hull 342 comprising a port 344 and starboard 346 hull members fixed together by frame 348. Frame 348 is covered by a sheet 350 to support the operator. The aerofoil body 352 is partially illustrated to show the associated controls. The swivel and pivot joint 354 is illustrated mounted between a first 356 and second 358 inboard framing members. There would be two or more additional framing members (not illustrated) depending on the size of the aerofoil body. The swivel and pivot joint comprises a first 360 and second 362 mounting members to which are mounted a first 364 and second 366 cambered members. Bridging the first and second cambered members is a member 368 comprising a ball and socket joint where the ball portion is mounted to the top end of the mast and the socket is integral to the bridge member 368. This arrangement permits port and starboard tilting of the aerofoil body for maximum maneuverability and only allows a limited amount of tilting bow-ward and stern-ward to avoid inducing aerodynamic wind forces that might lift the vessel out of the water. The port tilt control line 380 and the starboard tilt control line 382 is a single line fixed at a first end 384 to a framing member between the mast and starboard side of the aerofoil body and a fixed at a second end 386 to a framing member between the mast and the port side of the aerofoil body. The tilt control lines are bound at 388 to a tilt control rod 390 which has a first end fixed in a pivoting relationship with catamaran framing member 392 and a second free end that is engaged with a serrated catamaran framing member 396. The control rod 390 is illustrated engaged with a central serration 398 on member 396 to maintain the aerofoil body horizontal. To induce a port-side tilt to the aerofoil body the operator disengages the rod 390 from the middle serration and moves the rod to starboard to engage another of the serrations. A similar operation is used to induce a starboard tilt by moving the control rod to the port and engaging another serration. The tilt control line communicates with the control rod through a first set of pulleys 400 and 402 mounted at the base of the mast and a second set of pulleys 404 and 406 mounted at each of the stern corners 408 and 410 of the catamaran frame. A forward tensioning control line 412 is mounted between the centre leading edge 414 of the aerofoil body and the mast to bias the aerofoil to the horizontal position. The haul line 416 is illustrated as engaging pulley 418 fixed to the trailing edge 420 of the aerofoil body and having a first end fixed to traveler 422 on traveler rod 424 for port-starboard motion. The second end 426 of the haul line is free for control by the operator so that pulling on the second end will pull the aerofoil trailing edge toward the centerline of the vessel. A port 428 and starboard 430 stays are illustrated fixed between the mast and the catamaran frame. The tiller arm 432 is illustrated in mechanical communication with the port 434 and starboard 436 rudders.

Figure 10:
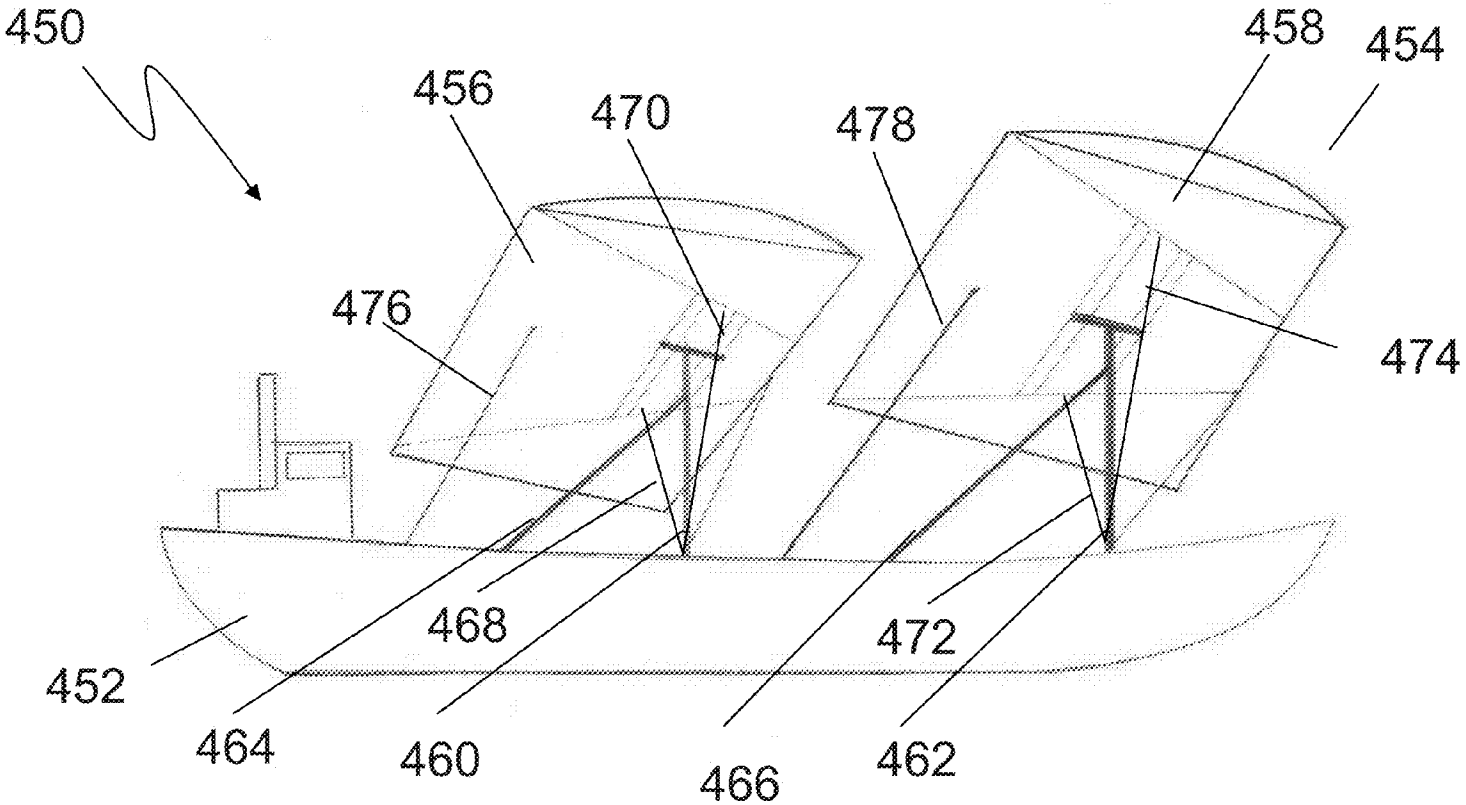
FIG. 10 is a view of my invention mounted to a large cargo vessel.

FIG. 10 illustrates another embodiment of the invention 450 wherein the vessel 452 is a large cargo vessel displacing thousands of tons. The sail system 454 can be a double aerofoil 456 and 458 as illustrated or the sail system can be a plurality of aerofoils. The sail system on the larger vessels is the same as on the smaller vessels. Each aerofoil is support by a mast 460 and 462 and each mast is stabilized by at least one stay 464 and 466. The control lines some of which are visible in this figure would be configured substantially the same as in the smaller vessels with port and starboard tilt control lines (468 to 474) and haul lines (476 and 478) linked to a winch mechanism (not shown) so that the aerofoils could be controlled in unison. Computer means (not shown) including wind sensing means can be installed to control the sails in order to optimize wind propulsion and save fuel.

This description contains much specificity that should not be construed as limiting the scope of the invention but merely provides illustrations of some of its embodiments. Thus the scope of the invention should be determined by the appended claims and their legal equivalents rather than by the examples given.

What is claimed is:

1. A sailing craft comprising a tilting sail system, said sailing craft having a hull having a bow and a stern, a port side and a starboard side, said sail tilting sail system comprising:

a. a sail comprising an rigid aerofoil body capable of omni-directional attitude for wind propulsion, wherein said rigid aerofoil body comprises a top skin, a bottom skin and a frame, and wherein the rigid aerofoil body encloses a volume of air and has a centre of gravity;

b. a vertical mast for supporting said aerofoil body, wherein said vertical mast has a top end mounting a swivel and pivot joint for connecting to the aerofoil body by way of a mounting member at a point disposed above said centre of gravity so that the aerofoil body is biased towards a horizontal position, and wherein said swivel and pivot joint permits and allows omni-directional attitude of the aerofoil body, and further wherein the vertical mast has a bottom end fixed to the sailing craft;

c. a wind force damper disposed within said top end of said vertical mast and connected to the swivel and pivot joint and hence to the aerofoil body for damping wind forces transmitted from the aerofoil body to the vertical mast; and, d. aerofoil body control means for controlling the attitude of the aerofoil body for optimizing aerofoil inclination and surface area exposed to wind direction and for placing the aerofoil body in a forward propulsion attitude relative to wind direction.

2. The sailing craft of claim 1, wherein said aerofoil body includes floatation means disposed within the aerofoil body.

3. The sailing craft of claim 2, wherein the aerofoil body is self weather cocking.

4. The sailing craft of claim 3, wherein the aerofoil body comprises a leading edge, a trailing edge, an upper camber, an air chamber, a width, a length, a centre line, a port side, and a starboard side.

5. The sailing craft of claim 4 wherein said frame comprises at least four ribs, including a port side rib, a starboard side rib and at least two interior ribs disposed between the port side rib and the starboard side rib, wherein said at least four ribs are fixed to a leading edge spar member and a spar member disposed between said leading edge and said trailing edge of the body.

6. The sailing craft of claim 5:

a. wherein said pivot joint comprises a first and second yoke having a respective first and second axle sleeve, said first and second yoke fixed to said mounting member which is in turn fixed to said aerofoil body above the centre of gravity and wherein said pivot joint further comprises an axle mounted in said first and second axle sleeves; and, b. wherein said swivel joint comprises a vertical member having a member top end and an member open bottom end, wherein said member open bottom end is disposed within the vertical mast top end for rotational and reciprocating movement therein and wherein said member top end is fixed to a centre point of said axle.

7. The sailing craft of claim 6, wherein said wind force damper comprises:

a. a first member horizontally disposed within the vertical mast and fixed at a position below the vertical mast top end;

b. a damping spring disposed within the vertical mast top end, said damping spring having a spring bottom end and a spring top end, wherein said spring bottom end rests upon said first horizontally disposed member; and, c. a second member horizontally disposed within said vertical member and fixed within said vertical member at a middle position, wherein said second horizontally disposed member rests upon said spring top end and—transfers said wind forces from the aerofoil body to the damping spring.

8. The sailing craft of claim 1, wherein said control means comprises a first control line having a first end fixed to said leading edge and below the centre of gravity and a second end anchored to the vertical mast at a point proximate to the bottom end of the vertical mast, wherein said first control line is tensioned to control pitch of the aerofoil member.

9. The sailing craft of claim 8, wherein the control means further comprises aerofoil body tilt control comprising a second control line having a first end fixed to the aerofoil body below the centre of gravity and between the port side rib and the vertical mast and a second end fixed to the aerofoil body below the centre of gravity and between the starboard side rib and the vertical mast, thereby creating said second control line port and starboard, and wherein the second control line travels down-mast to a set of pulleys mounted on the mast and to a two-way winch adapted to tension alternately the second control line port and the second control line starboard, thereby tilting the aerofoil body port and starboard as desired to bias the aerofoil body to the horizontal position upon loss of control line tension.

10. The sailing craft as claimed in claim 9, wherein the control means further comprises a third control line having a first end fixed to the aerofoil body at a point between said trailing edge and the vertical mast, and a second end fixed to a port-starboard traveling means fixed across the stern of the water craft, said traveling means adapted to move from port to starboard so that the aerofoil body can be rotated about the vertical mast and secured in a desired position.

11. A sailing craft comprising a tilting sail system, said sailing craft having a hull having a bow and a stern, a port side and a starboard side, said sail tilting sail system comprising:

a. a self weather cocking sail comprising a rigid and asymmetric aerofoil body capable of omni-directional attitude for wind propulsion, wherein said aerofoil body comprises a centre of gravity, a leading edge, a trailing edge, an upper camber, a centre line, a top skin and a bottom skin and a frame comprising a port side rib, a starboard side rib and at least two interior ribs wherein the aerofoil body encloses a volume of air;

b. a vertical mast having a top end fixed to said aerofoil body by a pivot/swivel joint and a bottom end fixed to said hull to, wherein said pivot/swivel joint permits and allows omni-directional attitude of the aerofoil body, and wherein a wind force damper is disposed within said top end of the mast;

c. aerofoil body control means for placing the aerofoil body in a forward propulsion attitude relative to wind direction, wherein said aerofoil body control means comprises a first control line fixed to said leading edge for controlling aerofoil body pitch, a second continuous control line for controlling tilt of the aerofoil body having a first end fixed to the aerofoil body between said starboard rib and the mast and a second end fixed to the aerofoil body between said port side rib and the mast wherein said second continuous control line is tensioned port or starboard by a two-way winch, and a third control line having a first end attached to said aerofoil body centre line between said trailing edge and the mast and a second end attached to port-starboard traveling means fixed across said stern.

* * * * *